US010066380B2

(12) United States Patent
Jorsch et al.

(10) Patent No.: US 10,066,380 B2
(45) Date of Patent: Sep. 4, 2018

(54) TOILET BOWL DISCHARGE VALVE ASSEMBLY

(75) Inventors: Thomas C. Jorsch, Sheboygan, WI (US); Benjamin W. Marotz, Kohler, WI (US); Charles R. Kopplin, Sheboygan, WI (US); Jeffrey F. Tempas, Oostburg, WI (US)

(73) Assignee: KOHLER CO., Kohler, WI (US)

( * ) Notice: Subject to any disclaimer, the term of this patent is extended or adjusted under 35 U.S.C. 154(b) by 0 days.

(21) Appl. No.: 13/549,126

(22) Filed: Jul. 13, 2012

(65) Prior Publication Data

US 2012/0278986 A1 Nov. 8, 2012

Related U.S. Application Data

(63) Continuation of application No. 11/525,494, filed on Sep. 22, 2006, now Pat. No. 8,230,533.

(51) Int. Cl.
*E03D 11/10* (2006.01)
*E03D 3/00* (2006.01)

(52) U.S. Cl.
CPC ..... *E03D 11/10* (2013.01)

(58) Field of Classification Search
CPC ..... E03D 5/012; E03D 11/10; E03D 3/00; E03D 5/00; E03D 5/08; E03D 11/08; E03D 11/00; E03D 5/09; E03F 1/006; B61D 35/007; B61D 35/005; A63H 29/08; B60R 15/04; B63B 29/00; B63B 2705/00
USPC ..... 4/434–442; 251/192, 298–301, 303
See application file for complete search history.

(56) References Cited

U.S. PATENT DOCUMENTS

| | | | | |
|---|---|---|---|---|
| 168,613 | A | | 10/1875 | Carr |
| 209,996 | A | | 11/1878 | Wellington |
| 234,570 | A | | 11/1880 | Hellyer |
| 258,454 | A | | 5/1882 | Mansur |
| 279,048 | A | | 6/1883 | Tweeddale |
| 283,172 | A | | 8/1883 | Walsh |
| 289,495 | A | * | 12/1883 | Bennor ..... 4/434 |
| 299,333 | A | | 5/1884 | Birkett |
| 717,651 | A | | 1/1903 | Allen |
| 1,126,937 | A | | 2/1915 | Barnstead |
| 2,833,147 | A | | 4/1959 | Mirza et al. |
| 3,214,772 | A | | 11/1965 | Roberts et al. |
| 3,379,408 | A | * | 4/1968 | Lowrey ..... 251/298 |
| 3,599,248 | A | | 8/1971 | Fulton et al. |
| 3,663,970 | A | | 5/1972 | Drouhard, Jr. et al. |
| 3,689,026 | A | * | 9/1972 | Self et al. ..... 251/160 |

(Continued)

FOREIGN PATENT DOCUMENTS

| | | |
|---|---|---|
| CN | 2525319 Y | 12/2002 |
| CN | 2533164 Y | 1/2003 |

(Continued)

OTHER PUBLICATIONS

Publication and International Search Report of WO 2008/039035; publication date: Apr. 3, 2008; 26 pages.

(Continued)

*Primary Examiner* — Chee-Chong Lee
(74) *Attorney, Agent, or Firm* — Foley & Lardner LLP

(57) ABSTRACT

A valve for a toilet includes an inlet and a gate configured to prevent fluid flow through the inlet. The gate includes an at least partially spherical surface and is configured to pivot eccentrically relative to the spherical surface.

19 Claims, 6 Drawing Sheets

(56) References Cited

U.S. PATENT DOCUMENTS

| | | | |
|---|---|---|---|
| 3,885,771 | A | 5/1975 | Baumann |
| 3,902,694 | A | 9/1975 | Friedell |
| 3,904,170 | A | 9/1975 | Curran |
| 3,926,407 | A | 12/1975 | Forster et al. |
| 4,016,609 | A | 4/1977 | Graham |
| 4,155,129 | A | 5/1979 | Russell |
| 4,164,343 | A | 8/1979 | Graebner |
| 5,101,853 | A | 4/1992 | Mailliet et al. |
| 5,345,618 | A | 9/1994 | Sigler et al. |
| 6,212,700 | B1 | 4/2001 | Giesler et al. |
| 6,332,229 | B1 | 12/2001 | O'Malley et al. |
| 6,467,101 | B1 | 10/2002 | Artola |
| 7,284,286 | B1 | 10/2007 | Kopplin et al. |
| 2001/0052147 | A1 | 12/2001 | Lee |
| 2005/0111942 | A1 | 9/2005 | Koester et al. |
| 2008/0047053 | A1 | 2/2008 | Grech et al. |

FOREIGN PATENT DOCUMENTS

| | | | |
|---|---|---|---|
| EP | 1124021 | | 8/2001 |
| FR | 359559 | A | 3/1906 |
| GB | 601812 | A | 5/1948 |
| JP | S49-25244 | | 3/1974 |
| JP | S56-134977 | | 10/1981 |
| JP | S63-45889 | | 3/1988 |
| JP | H6-33505 | | 5/1997 |
| SU | 1036764 | | 12/2001 |
| WO | WO9741315 | A1 | 11/1997 |

OTHER PUBLICATIONS

European Examination Report for Application No. 07 838 161.3; dated Jul. 9, 2009; 3 pages.

International Preliminary Report on Patentability of PCT/US2007/019906; dated Mar. 24, 2009; 8 pages.

A Mar. 23, 2010 Russian Office Action from a corresponding application with translation thereof.

12 pages of a PCT ISR dated Apr. 1, 2010 from corresponding application No. PCT/US2007/019914.

4 pages of a Nov. 20, 2009 PCT Search Report from corresponding application No. PCT/US2007/019914.

* cited by examiner

TOILET BOWL DISCHARGE VALVE ASSEMBLY

CROSS-REFERENCE TO RELATED APPLICATION

This application is a Continuation of U.S. application Ser. No. 11/525,494, filed Sep. 22, 2006, which is incorporated herein by reference in its entirety.

STATEMENT OF FEDERALLY SPONSORED RESEARCH OR DEVELOPMENT

Not applicable.

BACKGROUND OF THE INVENTION

The present invention relates to toilets, and more particularly to valves controlling the outflow of waste from a toilet bowl to a toilet trap.

Although flushing type toilets aid in the sanitary disposal of human excrement, their level of water usage is of concern. A typical toilet includes a valve upstream of the toilet bowl, such as at the bottom of a water storage tank. When the toilet is flushed, the valve in such a water tank opens, and the tank water is able to flush into the toilet bowl.

However, with these conventional toilets, there is typically a delay between the beginning of the flushing cycle and the time that most of the crude waste has been removed from the bowl. Thus, there can be an undesirably large amount of flushing water required to just move the main waste out of the bowl, and a further amount is needed to provide the final rinse.

One approach for reducing this level of water usage is to provide an outlet valve immediately downstream of the toilet bowl outlet that is configured such that when it is opened most of the waste in the bowl can drop out of the bowl regardless of any new flush water entering the bowl. An example of this approach is depicted in U.S. Pat. No. 279,048.

However, such valves sometimes result in clogging, maintenance or wear problems. Also, they may be expensive to produce or install, or be unreliable over prolonged use, particularly when closure is directly into the face of the bowl discharge outlet flow.

U.S. Pat. No. 5,345,618 teaches a trap valve connected to a toilet bowl discharge outlet where a sphere segment gate is caused to rotate on an axis that is also the center of radius for the sphere. This provides a sliding closure of the discharge outlet. A problem with this design is that as the spherical gate rotates across the sealing element or gasket, the gate is continuously abrading the gasket, which wears the gasket and can lead to a loss of fluidic seal at the valve gate. Further, the bowl outlet which is closed by the gate, is positioned in a horizontal plane which causes the leading edge of the gate to start closing the orifice from an approximate 9 o'clock position to beyond a 3 o'clock position. This involves some movement during the closure against the gravity force of the bowl waste.

Other examples of trap valves and valves with sphere segment gates are disclosed in U.S. Pat. Nos. 289,495, 3,214,772, 3,599,248, 3,885,771, 3,926,407, 4,164,343, 6,212,700, 5,345,618, 6,332,229; as well as U.S. patent application 2005/0211942. However, notwithstanding these developments, a need still exists for improved toilet trap valve assemblies, particularly those which facilitate flushing with reduced amounts of water.

SUMMARY OF THE INVENTION

In one aspect the present invention provides a toilet having a bowl with a lower discharge outlet, a trap in fluid communication with the discharge outlet, and a trap valve positioned to control outflow from the discharge outlet to the trap. The trap valve has a valve housing having an entry, an exit, and a cavity connecting the entry and exit.

There is a gate valve positioned in the cavity and pivotable using linkage that extends from outside the housing to the gate valve. There is also a sealing gasket (preferably positioned adjacent the entry), so that the gate valve is pivotable from a first position blocking the entry and essentially closing off outflow from the discharge outlet, to a second position permitting flow from the discharge outlet to the trap, and so that the gate valve can begin closing off the entry when a lead edge of the gate valve is within 25° of vertical.

In preferred forms the valve housing is in the form of a cartridge having two clamshell parts defining the cavity. The gate valve can be in the form of a spherical segment having a radius of curvature extending from a center of curvature, such that the gate valve is pivotable about a center of rotation offset from said center of curvature.

Pivoting of the gate valve can be initiated as part of a flush cycle of the toilet, and the trap can have a normal trap water level to restrict back flow of sewer gases to the bowl, where the gate valve is positioned so as to be above that water level.

In another aspect the invention provides such a trap valve, albeit particularly where it is in the form of a cartridge suitable to be connected at one end to a toilet bowl discharge outlet and at another end to a toilet trap.

In another aspect the invention provides a toilet including a bowl having a lower discharge outlet, a trap in fluid communication with the discharge outlet, and a trap valve positioned to control outflow from the discharge outlet to the trap. The trap valve has a valve housing having an entry, an exit, and a cavity connecting the entry and exit. A gate valve is positioned in the cavity and pivotable using a linkage that extends from outside the valve housing to the cavity.

A sealing gasket is positioned adjacent the valve housing entry, wherein the gate valve is pivotable from a first position essentially closing off outflow from the discharge outlet to a second position permitting flow from the discharge outlet to the trap. The gate valve is linked to the linkage via a ball and socket arrangement.

In some embodiments, the present invention advantageously minimizes the tendency of the gate valve to abrade the sealing gasket, and helps to avoid leakage by placing the gate valve above the normal trap water level. Further, in those embodiments the closure requires little power as the gate is closing initially largely transversely to the flow out from the bowl, rather than directly upward.

In other embodiments a ball and socket joint is provided between the gate valve and its linkage so that as the gate valve closes it can correct for manufacturing tolerances or minor waste along the seal.

Additionally, should any maintenance issue arise with respect to the trap valve which requires replacement of the valve cartridge, or a component of it, the valve cartridge, or its component, can be replaced without having to dispose of the bowl or trap.

These and still other advantages of the present invention will be apparent from the detailed description which follows and the accompanying drawings. Hence, the following claims should be looked to in judging the invention.

DETAILED DESCRIPTION OF THE PREFERRED EMBODIMENTS

Figure 1:
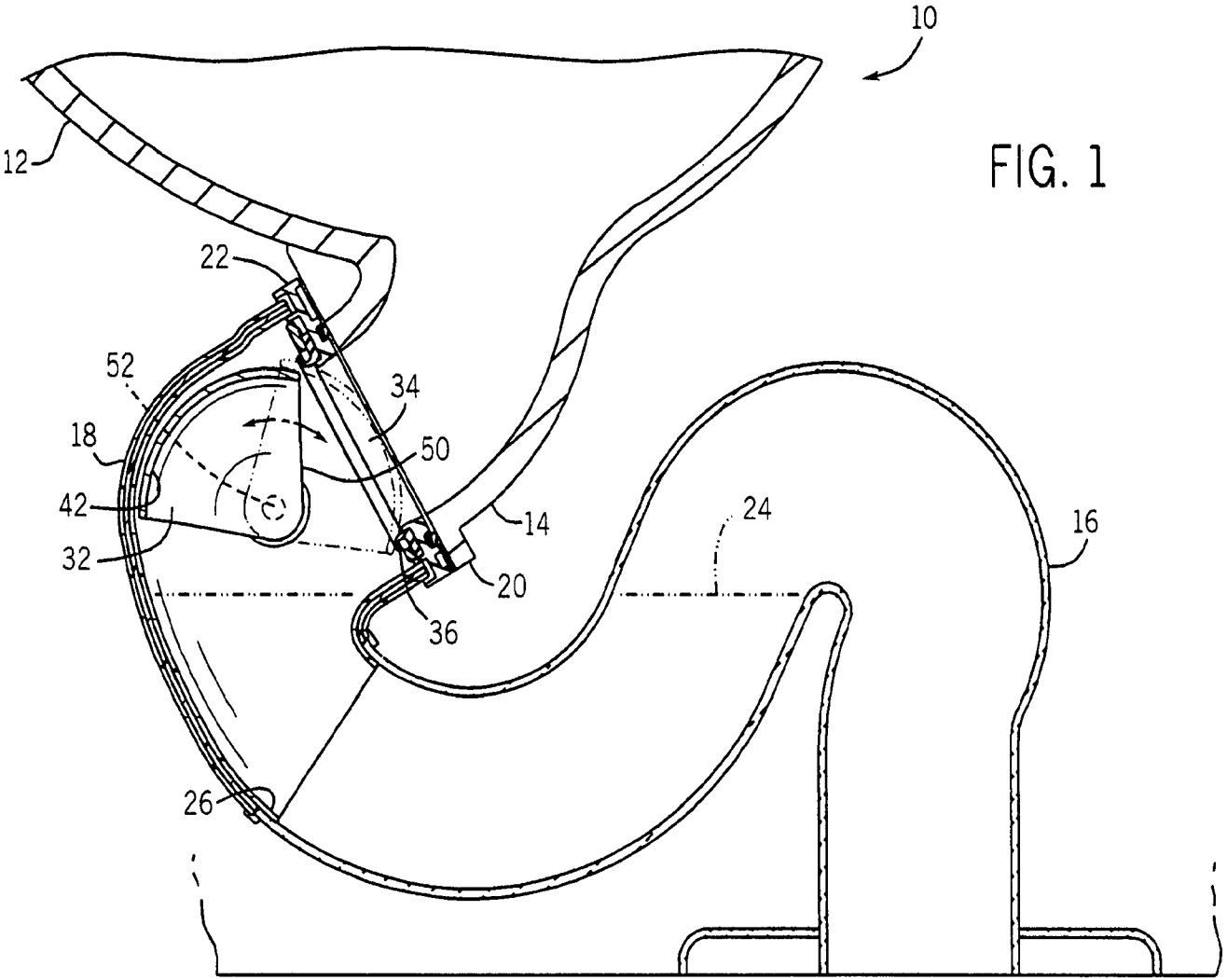
FIG. 1 is a vertical cross-sectional view through a portion of a lower toilet bowl and trap assembly constructed in accordance with the present invention.

Referring first to FIG. 1, there is shown the lower portion of a toilet generally 10, where there is the usual toilet bowl 12 with discharge outlet 14. Toilet 10 can otherwise be of a conventional construction.

For example, the toilet above the discharge outlet could have a structure analogous to that of U.S. Pat. No. 5,345,618, the disclosure of which is incorporated by reference as if fully set forth herein. Thus, there can be electrical or mechanical flush controls, including linkages from those controls to the trap valve 18. Alternatively, one could move the trap valve manually.

In any event, in the present embodiment, there is also a trap 16 in fluid communication with discharge outlet 14, and a trap valve 18 located downstream of bowl 12 and upstream of trap 16. Toilet 10 preferably includes a flange 20 near the bottom of bowl discharge outlet 14, and other connecting elements such as fasteners for connecting to the cartridge form trap valve 18 at flange 22.

Trap 16 has a normal trap water level 24 for preventing return of sewer gas, and can be connected to trap valve 18 at collar 26 with a flexible piece of rubber and/or other connector elements such as clamps (not shown). Trap valve 18 permits the passage of waste and fluid from bowl 12 to trap 16 when in the FIG. 1 open position.

Figures 2, 3:
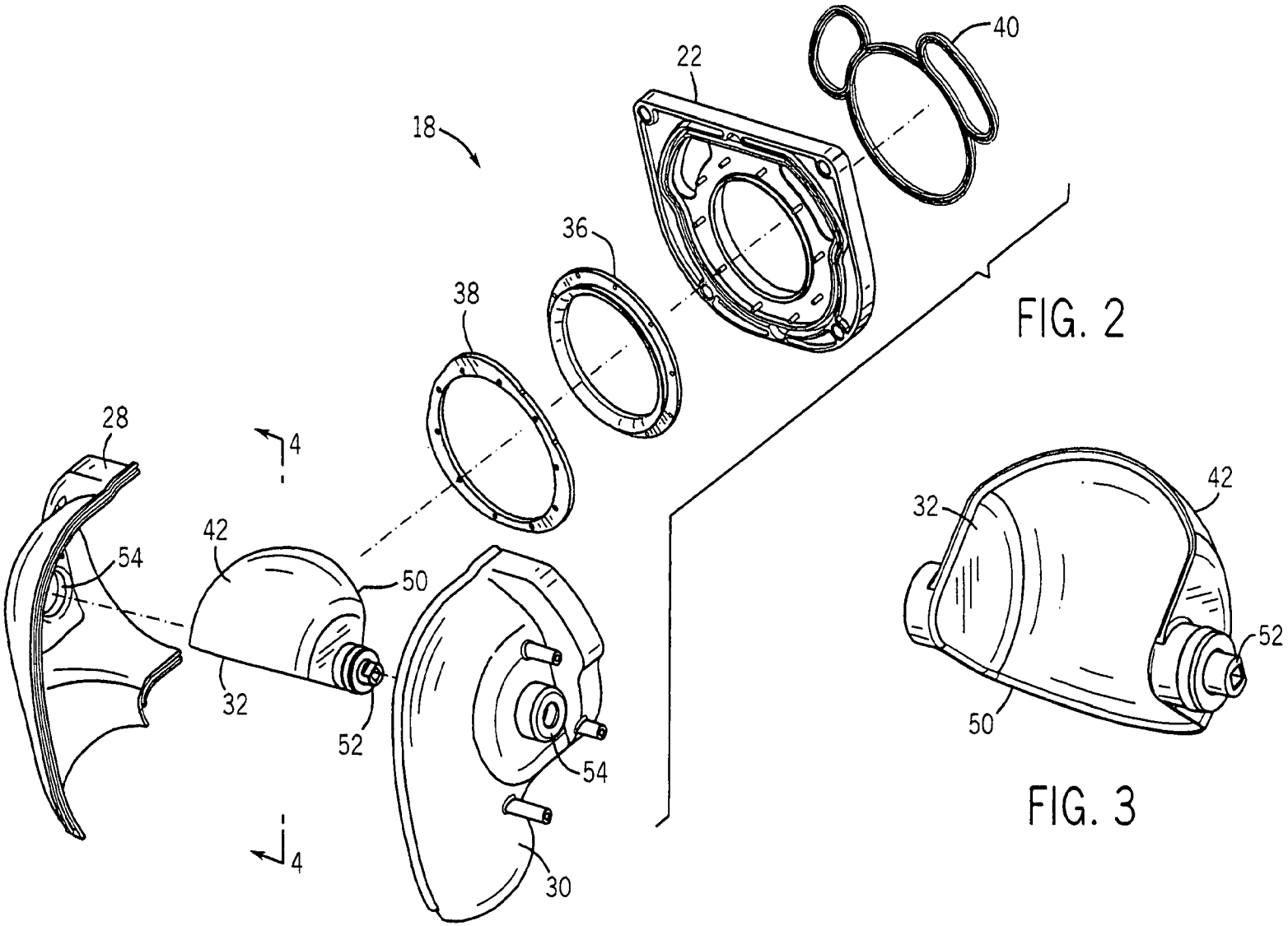
FIG. 2 is an exploded perspective view of a trap valve cartridge depicted in FIG. 1.
FIG. 3 is a perspective view of a gate valve of the FIG. 2 trap valve, the gate valve being viewed from a different perspective than as shown in FIG. 2.

Referring to FIGS. 1-3, trap valve 18 includes a first clamshell housing part 28, and a second generally mirror image clamshell housing part 30 connectible to first clamshell housing part 28. There is also a pivotable gate valve 32 mounted inside a cavity defined by the first and second clamshell housing parts 28/30.

Figure 5:
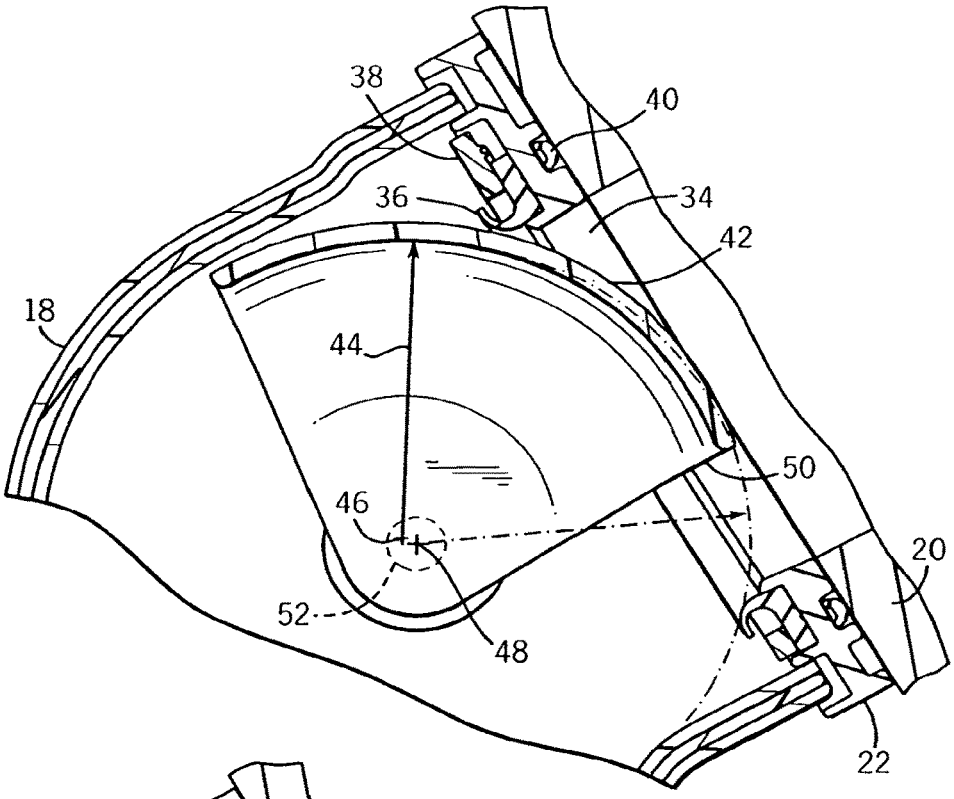
FIG. 5 is a further enlarged fragmentary cross-sectional view of a portion of FIG. 1, albeit now showing the gate valve in the process of closing.
Figure 6:
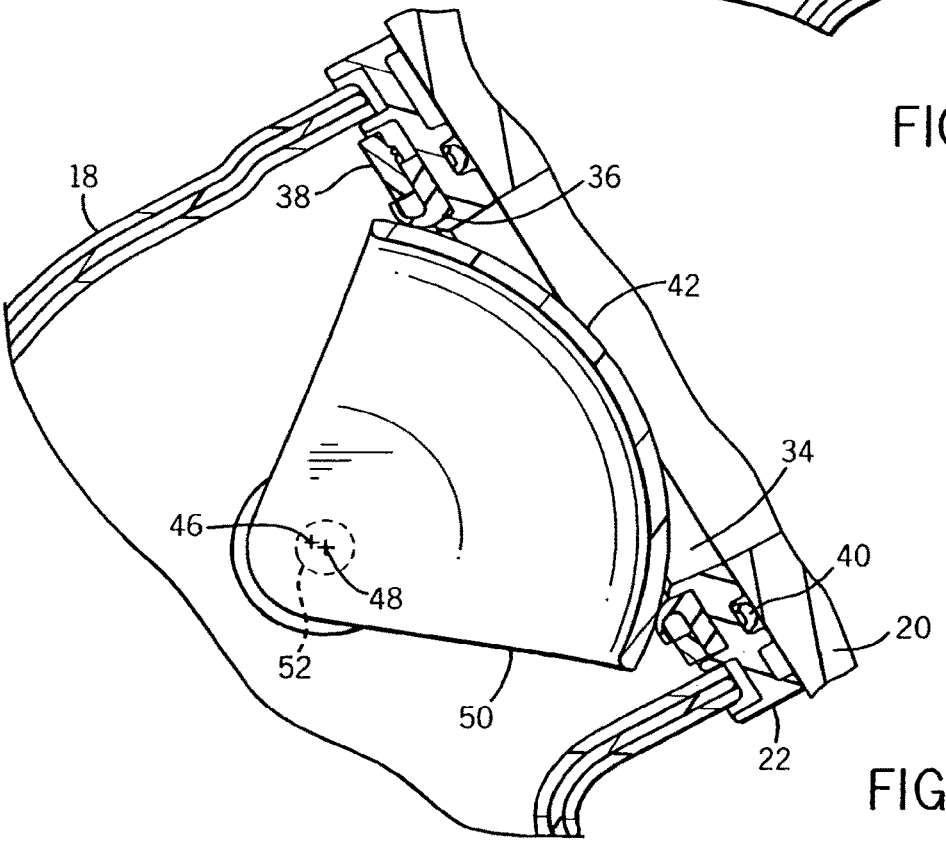
FIG. 6 is a view similar to FIG. 5, but with the gate valve now fully closed.

This cavity has an inlet orifice/entry 34 (see FIG. 1) which includes at least one gasket 36, 38, 40 surrounding inlet orifice 34. Pivotable gate valve 32 is positioned in the cavity so as to be able to move between a first closed position blocking inlet orifice 34 between flushes (FIG. 6), and an essentially open position (FIG. 1), and then a return position beginning to close off flow (as shown in FIG. 5).

Pivotable gate valve 32 preferably includes an essentially spherical contact segment 42 which has a radius of curvature 44 (FIG. 5) extending from a center of curvature 46. Pivotable gate valve 32 rotates about a center of rotation 48 offset from center of curvature 46, which results in a slightly eccentric rotation of gate valve 32 relative to its closure position. This allows spherical contact segment 42 to contact the sealing surface of gasket 36 fully only when gate valve 32 is in approximately the FIG. 6 position.

This means that the gate valve will not continuously scrape across the gasket 36 throughout the full swing of the gate valve closure. Rather, it closes in on the gasket sealing surface in an eccentric manner, thereby reducing wear and maintenance issues.

Moreover, the leading edge of the gate 50 cuts across the water exiting from the bowl transversely, rather than pushing up perpendicularly to the flow. This facilitates closure by helping to minimize the needed force to fight the effects of gravity.

Figure 4:
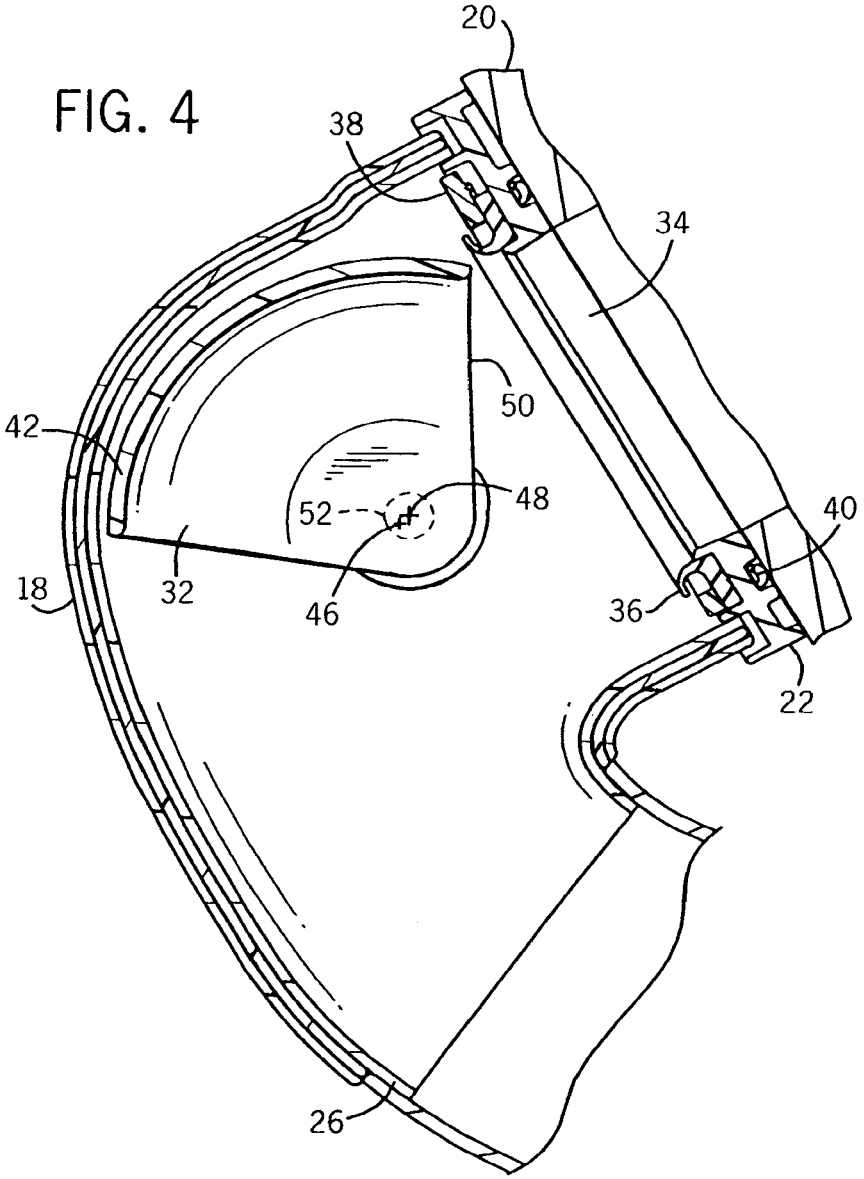
FIG. 4 is an enlarged, fragmentary, cross-sectional view of a portion of FIG. 1.

Most preferably, pivotable gate 32 has a leading edge 50 approximately between +40° and −40° (most preferably between +25° and −25°) from vertical when gate valve 32 is in the FIG. 4 position. Thus, leading edge 50 is approximately vertical when gate 32 begins to reduce the opening during closure.

As shown in FIGS. 1-6, gate valve 32 can comprise an approximately quarter spherical segment 42. Further, pivoting of the gate valve 32 can be caused by movement of a stem 52 that extends outside of housing parts 28, 30 and into the cavity.

Pivotable gate valve 32 can be positioned so as to always be above normal trap water level 24. This helps avoid having the trap valve components soak in sullied water between flushes, thereby reducing maintenance and leakage concerns. Also, waste does not tend to collect between the gate valve 32 and its cartridge cavity pocket. This reduces the resistance to opening which would occur if that would happen.

Stem 52 is connected to sockets 54 so that during a flushing cycle one trips a flush initiator connected to stem 52, which ultimately pivots the gate valve 32 out of the closed position. This permits waste to rapidly evacuate through inlet 34 of the valve cartridge. It is preferred that the start of the flush water be delayed slightly to permit most of the evacuation to occur before clean flush water starts to rinse the bowl.

After a defined period, trap valve 18 can have its gate valve 32 be caused to return to the FIG. 6 closed position, and preferably be latched in that position so that some water will remain in the bowl above gate valve 32 between flushes. The inlet water will then be shut off, ending the flush cycle.

Figure 7:
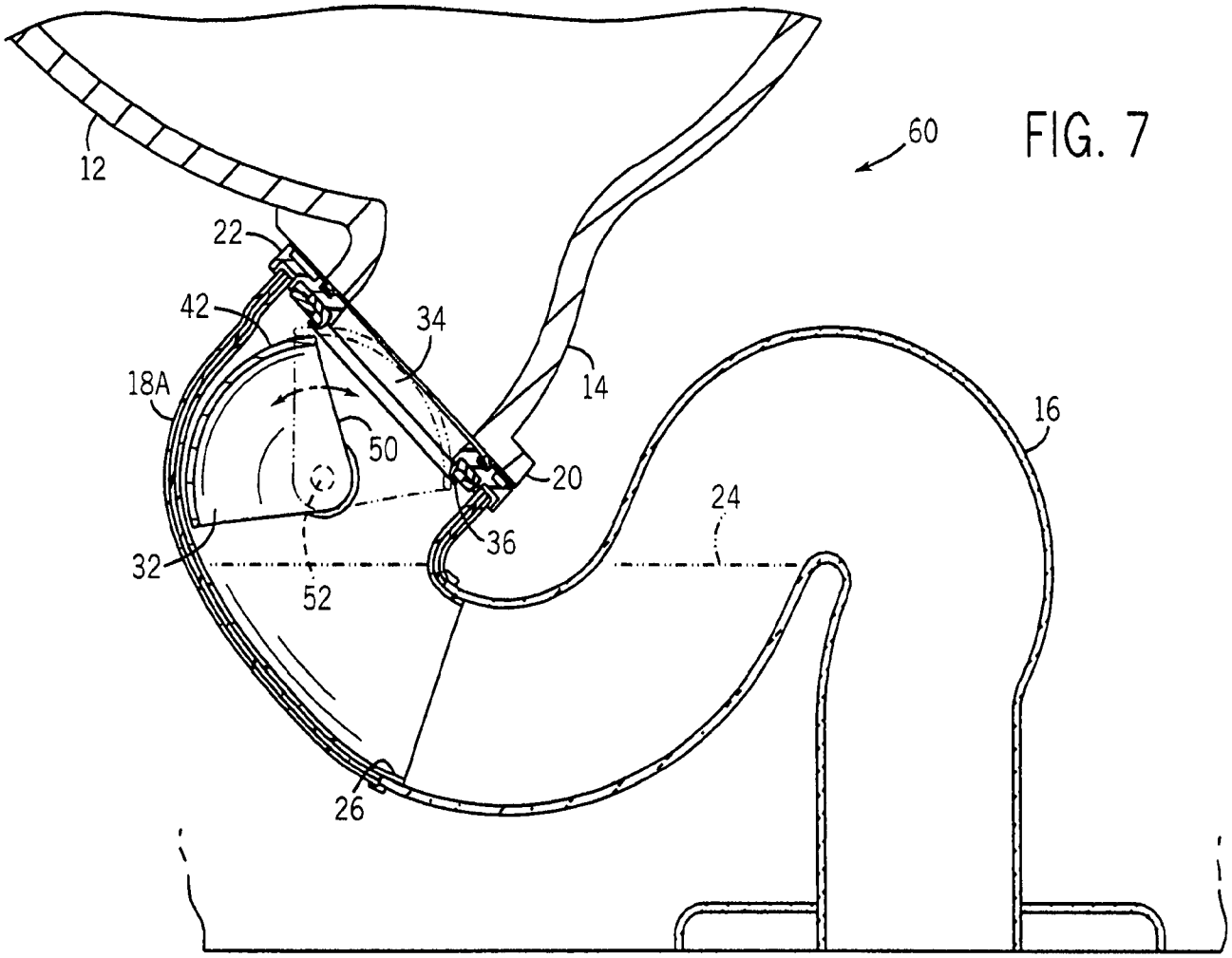
FIG. 7 is a view similar to FIG. 1, but of a second embodiment where the cartridge is attached to the bowl at a slightly different angle.

In the embodiment shown in FIG. 7, toilet 60 depicts trap valve cartridge 18A being at a slightly different angle of installation when compared to FIG. 1. Other elements are substantially the same as in FIG. 1, and hence are numbered in similar fashion.

Figure 8:
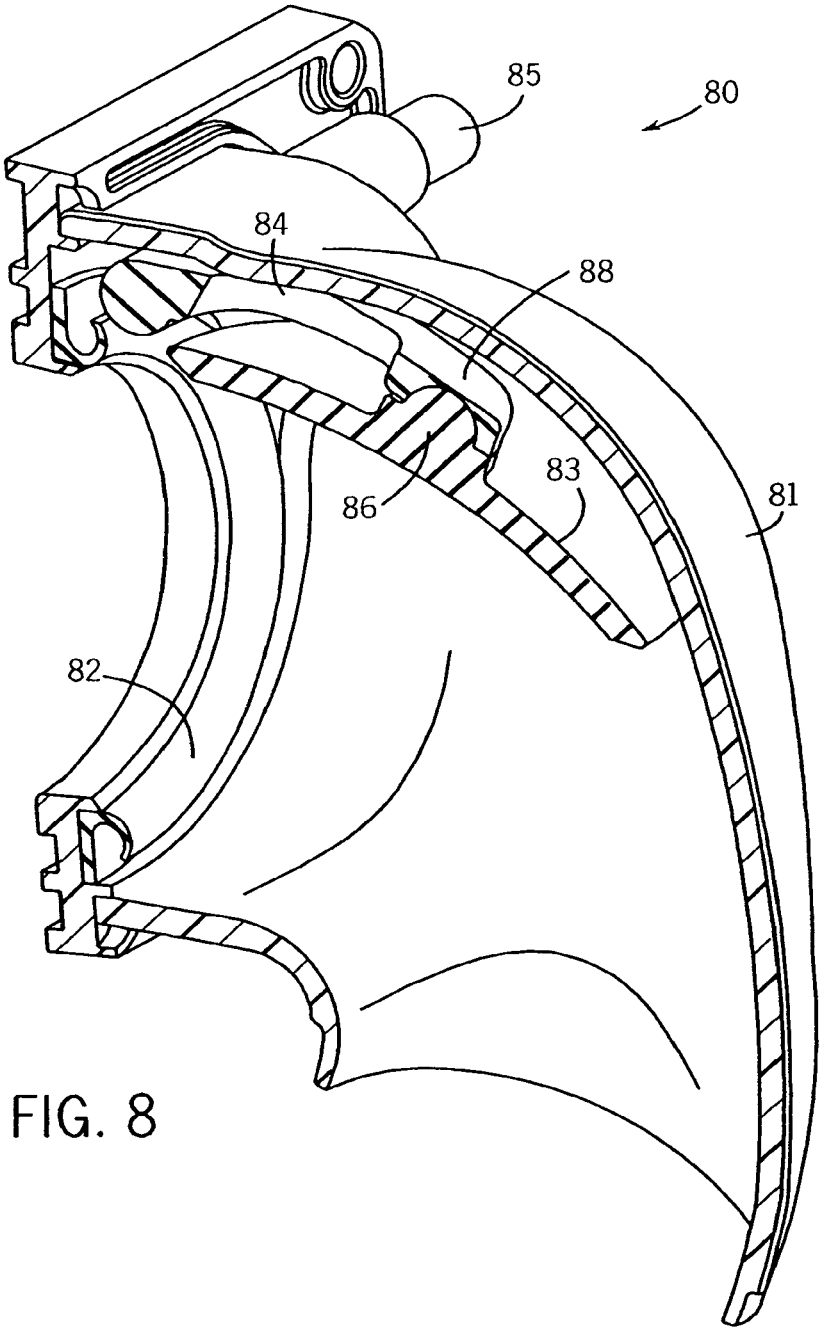
FIG. 8 is a perspective, cross-sectional view of another embodiment of a valve according to the present invention.

In the embodiment shown in FIG. 8, a trap valve 80 is positioned to control outflow from the discharge outlet of a toilet to the trap of the toilet. Trap valve 80 includes a housing 81 having an entry, an exit, and a cavity connecting the entry and exit. A sealing gasket 82 is positioned adjacent the valve housing entry. A gate valve 83 is positioned in the cavity and is pivotable using a linkage 85 that extends from outside the housing 81 to the cavity. Gate valve 83 is pivotable from a first position essentially closing off outflow from the discharge outlet to a second position permitting flow from the discharge outlet to the trap. There is an arm 84 connected to linkage 85, the arm being pivotably connected to gate valve 83.

In the embodiment shown in FIG. 8, the connection between arm 84 and gate valve 83 is a ball 86 and socket 88 arrangement. This allows the position of gate valve 83 to adjust as it is pressed against sealing gasket 82 in the closed position, and therefore increases the chances that the gate valve 83 seals (by making it less susceptible to assembly tolerances and minor debris on the seal).

Regardless of the embodiment, the present invention facilitates use of a trap valve to control toilet bowl evacuation. Maintenance concerns relating to wear on a sealing gasket are reduced by the eccentric closure. The positioning of the gate valve near vertical as the closure gate starts in some embodiments facilitates closure in the face of the weight of the bowl material. Positioning of the gate valve above the trap water level further reduces maintenance issues and helps with reliability.

The cartridge valve can be made of metal or plastic components.

While preferred embodiments of the present invention have been disclosed, it should be appreciated that still other modifications and variations to the preferred embodiments will be apparent to those skilled in the art, and are intended to be within the spirit and scope of the invention. For example, while the cartridge valve is preferably used with a ceramic bowl and trap, it can also be used with toilet components made of other materials (e.g. metallics; plastics). Further, the angle of installation of the trap valves 18/18A and gate 32 can vary somewhat.

Therefore, the present invention is not to be limited to just the described most preferred embodiments. To ascertain the full scope of the invention, the claims which follow are referenced.

INDUSTRIAL APPLICABILITY

The invention provides toilets which have improved trap discharge valves.

We claim:

1. A toilet valve, comprising:

an inlet configured to be coupled to a discharge outlet of a toilet;

an outlet configured to be coupled to a trap of the toilet that is configured to hold water between flushes to block sewer gas; and a gate configured to be positioned above the water held in the trap, wherein the gate is rotatable about an axis to prevent fluid flow through the inlet of the toilet valve in a closed position, the gate comprising:

an arcuate member having a convex surface that is eccentric relative to the axis and that extends laterally between a first peripheral edge and a second peripheral edge;

a pair of laterally spaced apart side members comprising a first side member, which extends directly from the first peripheral edge, and a second side member, which extends directly from the second peripheral edge;

a first stem extending laterally outward from an outside of the first side member, and a second stem extending laterally outward from an outside of the second side member;

wherein the first and second stems are aligned concentrically and define the axis;

a housing that includes:

a first clamshell part having a first socket with an aperture that receives the first stem, wherein the first stem rotates within the aperture of the first socket relative to the first clamshell part; and a second clamshell part having a second socket with an aperture that receives the second stem, wherein the second stem rotates within the aperture of the second socket relative to the second clamshell part;

wherein the housing defines the inlet and a cavity, and the gate is positioned within the cavity.

2. The toilet valve of claim 1, wherein the toilet valve is configured to be coupled to a toilet to control discharge of waste from the toilet when the toilet is flushed.

3. The toilet valve of claim 1, wherein the convex surface is at least partially spherical.

4. The toilet valve of claim 1, wherein the convex surface of the gate includes a segment defining one fourth of a sphere.

5. The toilet valve of claim 1, wherein the gate is configured for the convex surface to engage a gasket to seal the inlet.

6. The toilet valve of claim 5, wherein the toilet valve includes the gasket, and the gasket surrounds the inlet.

7. The toilet valve of claim 5, wherein the gate is configured such that as the gate pivots from an open position toward the closed position, the gate does not simultaneously begin to restrict flow through the inlet and begin to engage the gasket.

8. The toilet valve of claim 5, wherein the gate is configured such that the gate does not continuously scrape across the gasket as the gate pivots between the closed position and an open position.

9. The toilet valve of claim 1, wherein the gate is configured such that as the gate pivots from an open position toward the closed position, the gate begins to restrict fluid flow through the inlet when a leading edge of the gate begins to be within an angle that is 40 degrees or less relative to vertical.

10. The toilet valve of claim 1, wherein the gate is configured such that as the gate pivots from an open position toward the closed position, the gate begins to restrict fluid flow through the inlet when a leading edge of the gate begins to be within an angle that is 25 degrees or less relative to vertical.

11. The toilet valve of claim 1, wherein at least one of the pair of laterally spaced apart members includes one of the first stem or the second stem extending laterally outward therefrom, one of the first stem or the second stem configured to be received in a socket and coupled to a flush initiator of the toilet to control a pivoting movement of the gate.

12. A toilet trap valve, comprising:

a housing defining a fluid passage that extends between an inlet end and an outlet end of the housing, the housing comprising first and second sockets that are aligned concentrically on opposite sides of the fluid passage to define an axis;

the inlet end configured to be coupled to a discharge outlet of a toilet bowl;

the outlet end configured to be coupled to a trap of the toilet that is configured to hold water between flushes to block sewer gas; and a gasket disposed in an inlet opening in the inlet end;

a connecting flange configured to carry the gasket and to secure the housing to the discharge outlet of the toilet bowl; and a gate that is located within the fluid passage and configured to be positioned above the water held in the trap, wherein the gate is configured to rotate about the axis to selectively engage the gasket in a closed position to prevent fluid from flowing through the fluid passage, wherein the gate comprises:

an arcuate member having a semi-spherical surface, which contacts the gasket in the closed position and extends laterally from a first peripheral side to a second peripheral side;

a first side member that is directly coupled to the arcuate member at the first peripheral side;

a first stem that extends directly from the first side member and is rotatably disposed within the first socket of the housing;

a second side member that is directly coupled to the arcuate member at the second peripheral side; and a second stem that extends directly from the second side member and is rotatably disposed within the second socket of the housing;

wherein the first and second stems are aligned concentrically with the axis and spaced apart from one another along the axis;

the housing further includes:

a first clamshell part having the first socket with an aperture that receives the first stem, wherein the first stem rotates within the aperture of the first socket relative to the first clamshell part; and a second clamshell part having the second socket with an aperture that receives the second stem, wherein the second stem rotates within the aperture of the second socket relative to the second clamshell part;

wherein the housing defines the inlet end and a cavity, and the gate is positioned within the cavity.

13. The toilet trap valve of claim 12, wherein the gate is configured to hold water in the toilet bowl between flushes, and the connecting flange has a first channel, which receives the inlet end of the housing, and a second channel, which receives the gasket.

14. The toilet trap valve of claim 13, wherein when the gate is in a fully open position, the gate does not overlap with the inlet end.

15. A toilet valve, comprising:

a hollow housing defining a fluid passageway extending between an inlet of the housing and an outlet of the housing; and the inlet of the housing configured to be coupled to a discharge outlet of a toilet;

the outlet of the housing configured to be coupled to a trap of the toilet that is configured to hold water between flushes to block sewer gas; and a gate valve that is disposed in the fluid passageway within the housing and configured to be positioned above the water held in the trap, wherein the gate is rotatable relative to the housing about an axis of rotation, the gate valve comprising:

a semi-spherical segment having a center of curvature that is eccentric relative to the axis of rotation; and two concentric stems that extend in opposite directions from opposite sides of the segment;

wherein the two stems define the axis of rotation and each stem directly engages the housing; and wherein the housing comprises two clamshell halves, each clamshell half comprises one socket having an aperture that rotatably receives one of the two stems of the gate valve, and the two sockets are concentric with the two stems.

16. The toilet valve of claim 15, wherein the inlet of the housing is mountable to an outlet of a toilet bowl, and the outlet of the housing is mountable to an inlet of a trap, and the toilet valve further comprises:

a flange configured to secure the inlet of the housing to the outlet of the bowl; and a gasket supported by the flange, wherein the semi-spherical segment of the gate valve directly contacts against a sealing surface of the gasket in a closed position of the gate valve.

17. The toilet valve of claim 15, wherein the gate valve further comprises:

a first side member extending from a first side of the semi-spherical segment, wherein a first of the two stems extends from the first side member in a first direction away from the semi-spherical segment; and a second side member extending from a second side of the semi-spherical segment that is opposite the first side of the semi-spherical segment such that the second side member is offset from the first side member, wherein a second of the two stems extends from the second side member in a second direction away from the semi-spherical segment, the second direction being opposite the first direction.

18. The toilet valve of claim 17, wherein at least one stem of the gate valve extends through the associated socket outside the housing to allow a flush initiator located outside the housing to directly connect to the at least one stem to rotate the gate valve upon actuation of the flush initiator.

19. The toilet valve of claim 17, wherein the center of curvature is on a line that is parallel to and offset from the axis of rotation, and wherein the two sockets are concentric with the axis of rotation.

* * * * *